US005183668A

United States Patent [19]

Murata et al.

[11] Patent Number: 5,183,668

[45] Date of Patent: Feb. 2, 1993

[54] PRESSURIZED SLIP CASTING APPARATUS

[75] Inventors: Kazushige Murata; Takeshi Ito, both of Aichi, Japan

[73] Assignee: Inax Corporation, Tokoname, Japan

[21] Appl. No.: 786,940

[22] Filed: Nov. 4, 1991

[30] Foreign Application Priority Data

Nov. 9, 1990 [JP] Japan ..... 2-305338

[51] Int. Cl.[5] ..... B28B 21/00

[52] U.S. Cl. ..... 425/84; 264/86; 425/225; 425/227; 425/229; 425/86

[58] Field of Search ..... 15/244.4; 100/131; 264/86, 87; 425/84, 85, 86, 90, 95, 96, 218, 225, 227, 229, 436 R, 436 RM

[56] References Cited

U.S. PATENT DOCUMENTS

| | | | |
|---|---|---|---|
| 2,898,658 | 8/1959 | Harry | 264/86 |
| 4,219,319 | 8/1980 | Gater et al. | 425/229 |
| 4,260,354 | 4/1981 | Gilman et al. | 15/244.4 |
| 5,046,937 | 9/1991 | Ito et al. | 425/85 |
| 5,083,911 | 1/1992 | Hisaeda et al. | 425/84 |
| 5,120,211 | 6/1992 | Ito et al. | 425/84 |

FOREIGN PATENT DOCUMENTS

| | | | |
|---|---|---|---|
| 2527502 | 12/1983 | France . | |
| 269721 | 4/1927 | United Kingdom | 425/229 |

*Primary Examiner*—Jay H. Woo
*Assistant Examiner*—Scott Bushey
*Attorney, Agent, or Firm*—Kanesaka and Takeuchi

[57] ABSTRACT

Herein disclosed is a pressurized slip casting apparatus which includes an upper mold carried vertically movably on a replacer which is made horizontally movably on a horizontal rail; and a lower mold for receiving the upper mold in alignment, when the upper mold descends, to cast a slip under pressure inbetween thereby to prepare a green body of a sanitation fixture or the like. Dehydrating assembly is carried vertically movably on the replacer. A spongy member is attached to the lower end of the dehydrating assembly for absorbing the water from the inside of the lower mold. A push plate is arranged at the side of the lower mold for pushing the spongy member to dehydrate the same.

3 Claims, 5 Drawing Sheets

PRESSURIZED SLIP CASTING APPARATUS

BACKGROUND OF THE INVENTION

1. Field of the Invention

The present invention relates to an improvement in an apparatus for slip casting under pressure for preparing a green body of a sanitation fixture or the like by the cast slip under pressure.

2. Related Art

When the green body of a sanitation fixture or the like is to be slip-cast in the prior art, there is used a pressuried slip casting mold which is composed of an upper mold and a lower mold. This slip casting mold is made mainly of a porous resin. The slip is poured into the mold, and a pressure is applied to the inside of the mold to cause the mold to absorb the moisture content in the slip so that the solid component in the slip may stick onto the inner wall of the mold. Simultaneously with this, the water content is absorbed from the mold by an evacuator so that the green body is more freed of water. At the parting time, the absorbed water content is returned to the inner wall of the mold to establish a water film in the interface between the green body and the mold so that the green body may part the mold. When one green body is cast by using one mold, this mold is used once more to prepare another green body. This casting process is repeated one after another. When the water content is reversed at the parting time in the apparatus of the prior art, the water frequently oozes from the upper mold or the like until it is reserved in the lower mold. If the slip is poured again for the slip casting into the mold containing the water, the green body wetting the inner wall of the mold is made excessively soft by the water reserved in the lower mold. Thus, a problem arises in that the green body may become defective.

OBJECT AND SUMMARY OF THE INVENTION

The present invention has been conceived in view of the aforementioned problem of the prior art and has an object to provide a pressurized slip casting apparatus capable of keeping the inside of the lower mold free of water.

According to the present invention, there is provided a pressurized slip casting apparatus comprising: an upper mold carried vertically movably on a replacer which is made horizontally movable on a horizontally rail; and a lower mold for receiving said upper mold in alignment, when said upper mold descends, to cast a slip under pressure inbetween thereby to prepare a green body of a sanitation fixture or the like, wherein the improvement comprises dehydrating means carried vertically movably on said replacer and including: a spongy member attached to the lower end of said dehydrating means for absorbing the water from the inside of said lower mold; and a push plate arranged at the side of said lower mold for pushing said spongy member to dehydrate the same.

The upper mold, which is carried vertically movably on the replacer, is aligned in the lower mold, and the slip is then cast under compression in the lower mold. Thus, the green body of the sanitation fixture or the like can be satisfactorily prepared in the mold. The water, if accumulated in the lower mold during the casting, can be satisfactorily absorbed by inserting into the lower mold the spongy member of the dehydrating means which in turn is carried vertically movably on the replacer. Moreover, the water thus absorbed by the spongy member can be removed by pushing the spongy member onto the push plate which is arranged at the side of the lower mold. Thus, at each step of casting the green body in the mold, the replacer can be moved to carry the dehydrating means to above the lower mold thereby to dehydrate the inside of the lower mold. As a result, it is possible to prevent the green body from becoming defective and to automate the dehydrations.

DESCRIPTION OF THE PREFERRED EMBODIMENT

Figure 1:
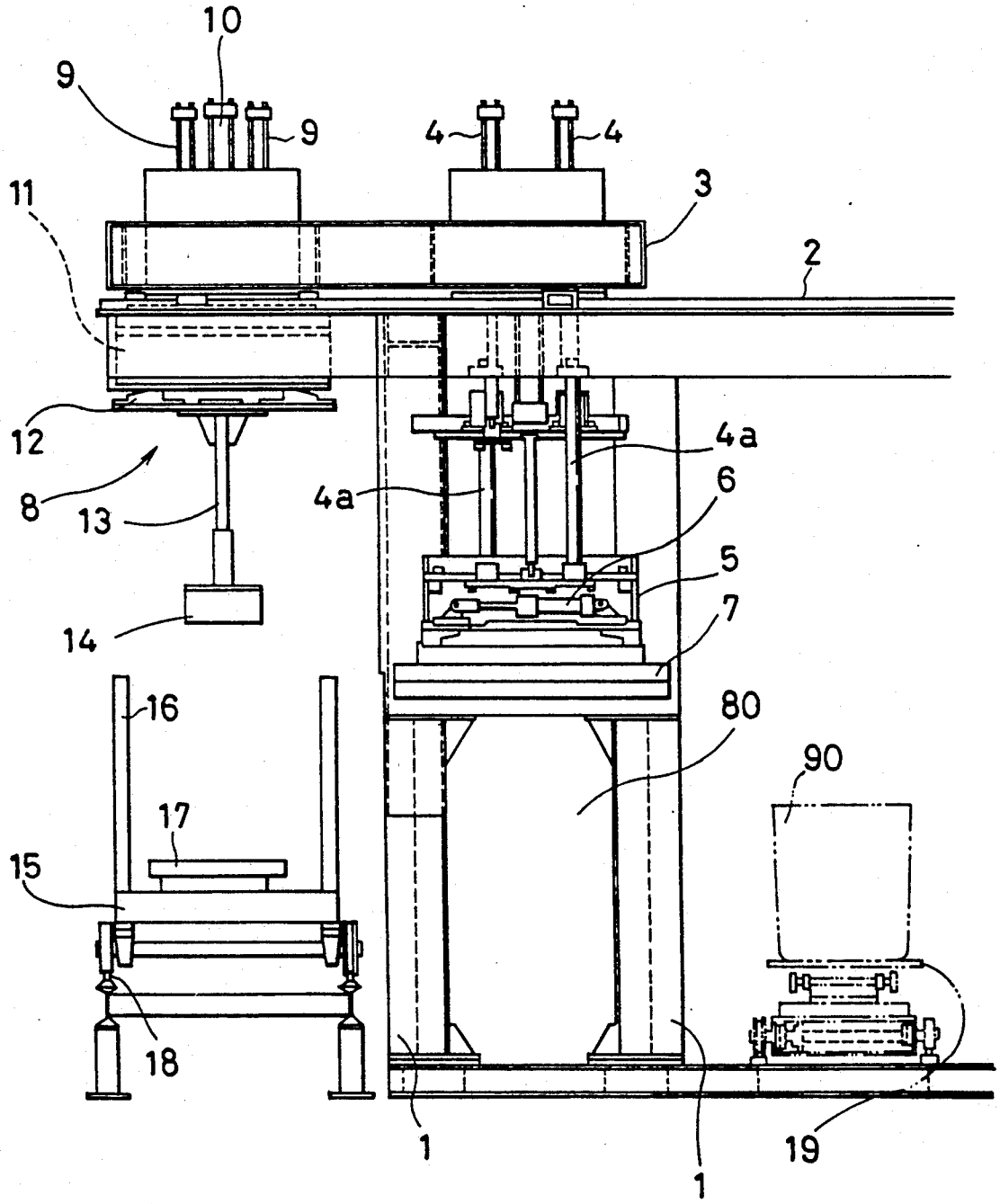
FIG. 1 is a schematic diagram showing a pressurized slip casting apparatus.

The present invention will be described in the following in connection with an embodiment thereof with reference to the accompanying drawings.

Above upright frames 1 and 1, there is arranged a horizontal rail 2. On this horizontal rail 2, there is horizontally movably arranged a framed replacer 3. At the righthand side of the replacer 3, as shown, there are erected two or more vertical cylinders 4 and 4. These vertical cylinders 4 and 4 have their rods 4*a* and 4*a* suspending therefrom and connected at their lower ends to a lift bed 5. On this lift bed 5, there is horizontally mounted a chuck cylinder 6, which is made operative to fit an upper mold 7 removably through chuck pawls 6A. This upper mold 7 is paired with a lower mold 20 to form a casting mold. This lower mold 20 (althrough not shown in FIG. 1) is fixed in a lower mold fixing space 80 which is defined between the frames 1 and 1. The upper mold 7 and the lower mold 20 are made of a porous synthetic resin and have a hollow cotton tube arranged in a buried state so that the hollow tube can absorb the water content of the porous resin to the outside of the casting mold.

At the lefthand side portion of the aforementioned replacer 3, on the other hand, there are erected two or more vertical cylinders 9 and 9, between which a guide cylinder 10 is erected. A lift bed 11 can be moved up and down along the guide cylinder 10 by the actions of the vertical cylinders 9 and 9. The lift bed 11 also has a not-shown chuck cylinder mounted therein for actuating a chuck 12. From this chuck 12, there removably depends a depending rod 13 which forms part of dehydrating means 8. To the lower end portion of the depending rod 13, there is attached a spongy member 14 which is made of a water-absorptive elastic material.

Below this spongy member 14, on the other hand, there is arranged a truck frame 16, in which a push plate 17 is horizontally disposed. The truck frame 16 is integrated with a truck 15 which is made to run on a rail 18. At a time of replacing the (aforementioned upper or lower) mold, the truck 15 is moved along the rail 18 to the outside so that it may replace the mold.

Here, the push plate 17 is arranged at the side of the aforementioned lower mold fixing space 80, and the dehydrating means 8 is arranged above the push plate 17 when the upper mold 7 is arranged above the space 80.

At the righthand side of this space 80, on the other hand, there is horizontally movably a take-out truck 19, which can carry a cast green body 90.

The operations of the pressurized slip casting apparatus thus constructed will be schematically described with reference to FIGS. 2 to 5.

Figure 2:
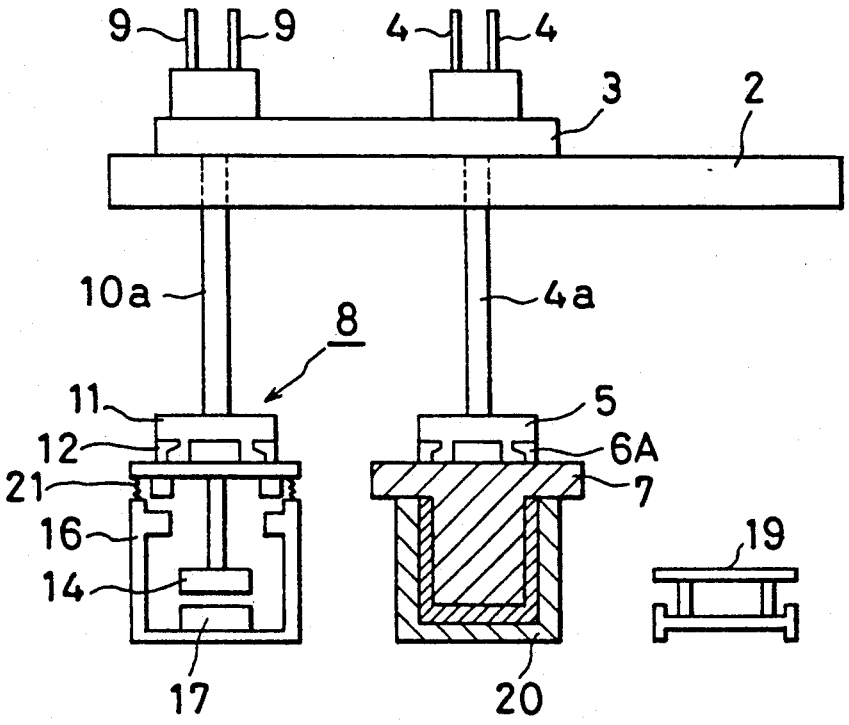
FIGS. 2 to 5 are schematic diagrams showing the individual operating states of the pressurized slip casting apparatus.

First of all, as shown in FIG. 1, the upper mold 7 is arranged above the lower mold 20, and the spongy member 14 is arranged above the push plate 17. In this state, the vertical cylinders 4 and 4, and 9 and 9 are operated to move the upper mold 7 down to fit the same in the lower mold 20. In this state, the slip is cast under pressure into the lower portion of the lower mold 20 and is caused to form the green body in the sticking state in the space which is defined by the upper mold 7 and the lower mold 20, as shown in FIG. 2. These upper and lower molds 7 and 20 are made of the resin arranged therein with the tube, through which the water content is absorbed from the inside of the molds and through which more water content is absorbed from the green body sticking to the molds into the mold thereby to make the green body harder and stronger.

Figure 3:
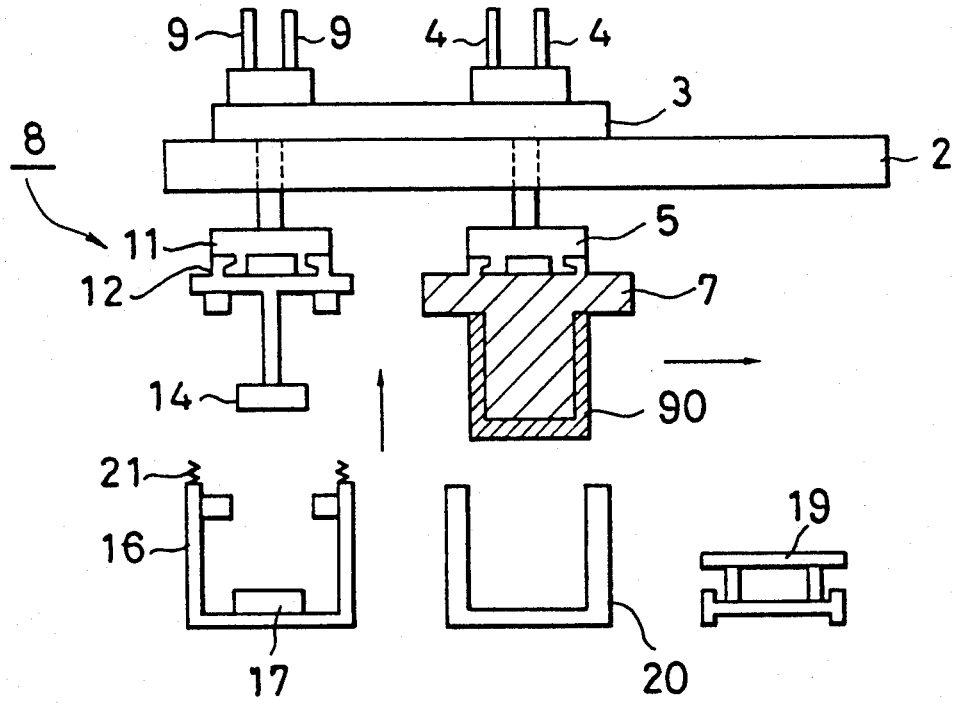
Figure 4:
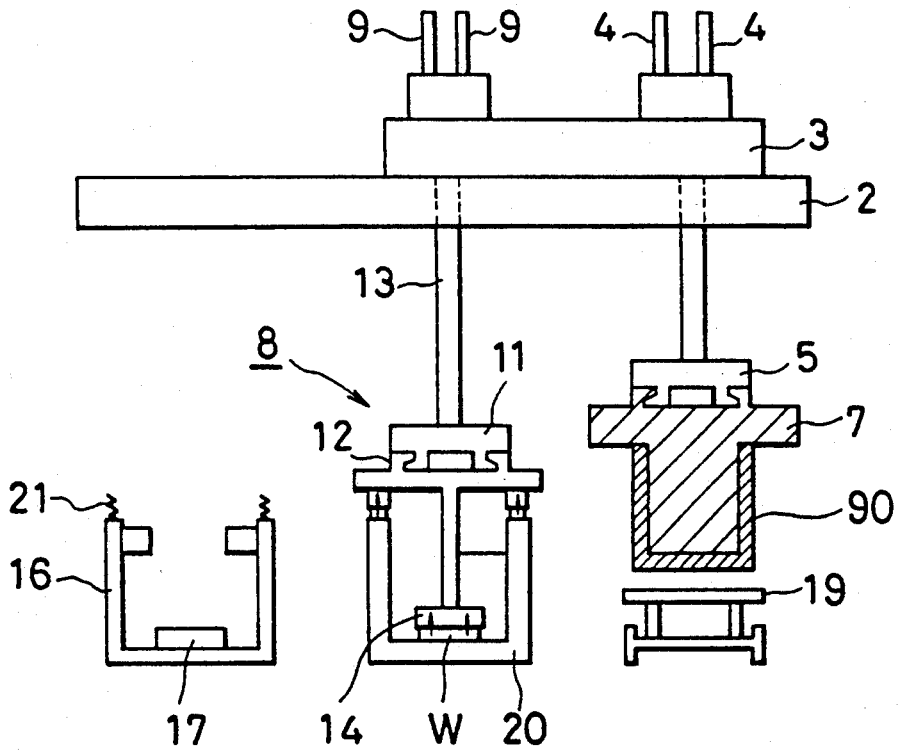

After this, water is pumped backward from the outside of the molds through the tube onto the surfaces of the molds to form a water film in the interface between the molds and the sticking green body thereby to allow the parting operation, as shown in FIG. 3. At this parting time, water will ooze from the surfaces of the molds and accumulate especially in the mold 20.

For the parting operation, as shown in FIG. 3, the upper and lower cylinders 4 and 4, and 9 and 9 are operated upward. Then, the cast green body is carried upward by the upper mold 7 as this mold 7 ascends. Next, the replacer 3 is moved rightward on the horizontal rail 2 until it is stopped at the position of FIG. 4. In this state of FIG. 4, the vertical cylinders 4 and 4 are operated downward to move the upper mold 7 down onto the take-out truck 19. After this, pressurized air is supplied from the outside to the tube in the upper mold 7 so that it is injected to the interface between the molds and the sticking green body 90. Then, this green body 90 leaves the upper mold 7 until it drops onto the take-out truck 19.

Along with these operations, the cylinders 9 are operated downward to move the suspending rod 13 forming part of the dehydrating means down into the lower mold 20 so that the spongy member 14 at the lower end of the rod 13 may absorb the water reserved in the lower mold 20.

Figure 5:
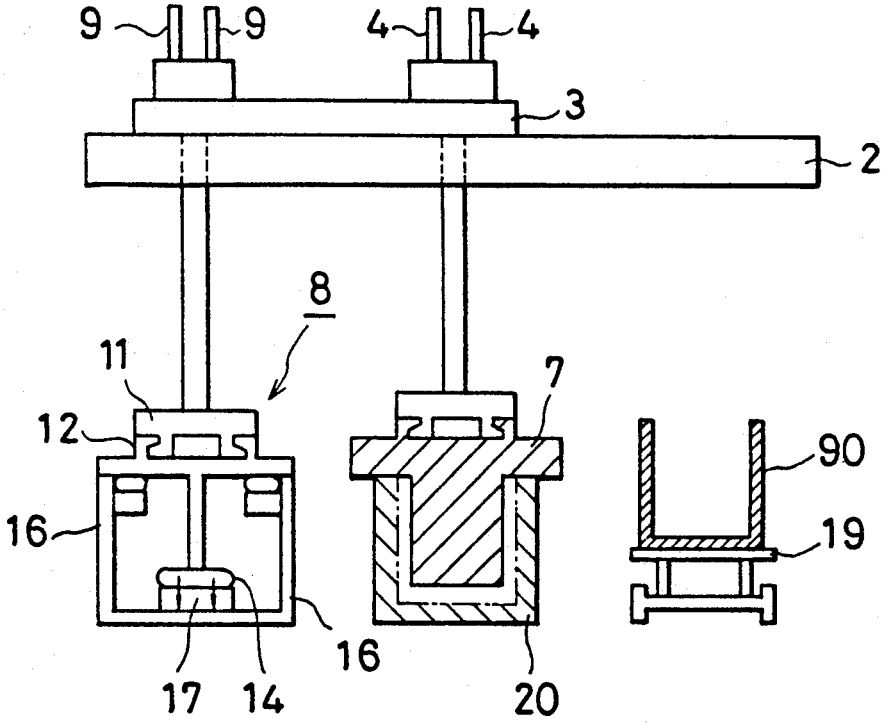

After this, the vertical cylinders 4 and 4, and 9 and 9 are operated upward, and the replacer 3 is then moved leftward on the horizontal rail 2. If the vertical cylinders 4 and 4, and 9 and 9 are operated downward, the state of FIG. 5 is established, in which the upper mold 7 is fitted in the lower mold 20. At this time, the suspending rod 13 is moved down into the truck frame 16 to push the spongy member 14 onto the push plate 17 so that the water content stored in the spongy member 14 is extracted to the outside.

If springs 21 or the like are mounted on the upper edges of the truck frame 16, as shown in FIG. 2, the dehydrating means 8 can be satisfactorily suspended.

Since the upper mold 7 and the dehydrating means 8 are thus vertically movably carried on the replacer 3, the water to be accumulated in the lower mold 20 at each of the steps of preparing the green body can be satisfactorily extracted out through the spongy member 14 so that the lower mold 20 can be cleared of any accumulation of water. As a result, the slit, which is cast under pressure in a next cycle, will not become soft so that no green body is defective.

Thus, according to the present invention, the water to be accumulated in the lower mold at each of the steps of preparing the green body can be absorbed by the spongy member of the dehydrating means, and the water thus absorbed can be satisfactorily discharged to the outside by pushing the spongy member onto the push plate. As a result, no water is accumulated in the lower mold. Thus, the green bodies do not become defective so that they can be continuously cast in a satisfactory state.

We claim:

1. A pressurized slip casting apparatus comprising:

a horizontal rail;

a replacer made horizontally movable on said horizontal rail;

an upper mold carried vertically movably on said replacer; and a lower mold for receiving said upper mold in alignment, when said upper mold descends, to cast a slip under pressure inbetween thereby to prepare a green body of a sanitation fixture, wherein the improvement comprises:

dehydrating means carried vertically movably on said replacer:

a spongy member mounted on a lower end of said dehydrating means for absorbing water from the inside of said lower mold; and a push plate arranged at a side of said lower mold for abutting and squeezing said spongy member to dehydrate the spongy member.

2. A pressurized slip casting apparatus according to claim 1, wherein said upper mold and said lower mold are made of a porous synthetic resin arranged therein with a tube made of a water-permeable material, and wherein said tube has its one end communicating with the outside of said molds for supplying water or air into said molds and for absorbing water from the inside of said molds.

3. A pressurized slip casting apparatus according to claim 1, wherein said dehydrating means moves in place of said upper mold to above said lower mold when said upper mold is lifted from said lower mold and retracted sideways, and wherein said spongy member is pushed to the bottom of said lower mold to absorb the accumulated water and is then moved upward, sideways and downward onto said push plate to have its water squeezed out.

* * * * *